US009592583B2

(12) United States Patent
Ishikawa et al.

(10) Patent No.: US 9,592,583 B2
(45) Date of Patent: Mar. 14, 2017

(54) POLISHING BRUSH AND MACHINING TOOL USING THE SAME

(71) Applicant: Aisin Seiki Kabushiki Kaisha, Kariya-shi (JP)

(72) Inventors: Shinya Ishikawa, Anjo (JP); Michihiro Yamamoto, Nishio (JP); Satoru Shibata, Okazaki (JP); Takamichi Hirasawa, Nisshin (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 70 days.

(21) Appl. No.: 14/559,979

(22) Filed: Dec. 4, 2014

(65) Prior Publication Data

US 2015/0165584 A1 Jun. 18, 2015

(30) Foreign Application Priority Data

Dec. 13, 2013 (JP) ..... 2013-258258

(51) Int. Cl.
*B24B 29/00* (2006.01)

(52) U.S. Cl.
CPC ..... *B24B 29/005* (2013.01)

(58) Field of Classification Search
CPC ..... B24D 29/005; B24D 13/145; B24D 13/14
USPC ..... 451/532
See application file for complete search history.

(56) References Cited

U.S. PATENT DOCUMENTS

| | | | | |
|---|---|---|---|---|
| 8,460,063 | B2 * | 6/2013 | Suzuki | B24D 13/10 451/283 |
| 2003/0104767 | A1 * | 6/2003 | Chilton | B24B 23/02 451/41 |
| 2005/0153642 | A1 * | 7/2005 | Matsushita | A46B 13/008 451/526 |
| 2006/0211343 | A1 * | 9/2006 | Yoshimura | B24B 9/00 451/51 |
| 2008/0064304 | A1 * | 3/2008 | Iga | B24B 7/12 451/57 |

FOREIGN PATENT DOCUMENTS

| | | |
|---|---|---|
| JP | 63-172553 U | 11/1988 |
| JP | 7-33558 U | 6/1995 |
| JP | 2005-111640 | 4/2005 |

* cited by examiner

*Primary Examiner* — Joseph J Hail
*Assistant Examiner* — Henry Hong
(74) *Attorney, Agent, or Firm* — Oblon, McClelland, Maier & Neustadt, L.L.P.

(57) ABSTRACT

A polishing brush includes: a brush body that includes a cylindrical base section and linear abrasive materials extending from a bottom surface of one side of the base section along a direction of a center of an axis of the base section, and removes burrs and performs polishing on a surface of a workpiece metal by relatively moving the abrasive materials and the workpiece metal while tips of the abrasive materials come into contact with a surface of the workpiece metal; a brush guide that is coaxial with the center of the axis and is disposed on the outside of the brush body in a radial direction so that the tips of the abrasive materials protrude from an end portion; and a displacement mechanism that changes protruding lengths of the abrasive materials from the end portion.

7 Claims, 8 Drawing Sheets

FIG.8

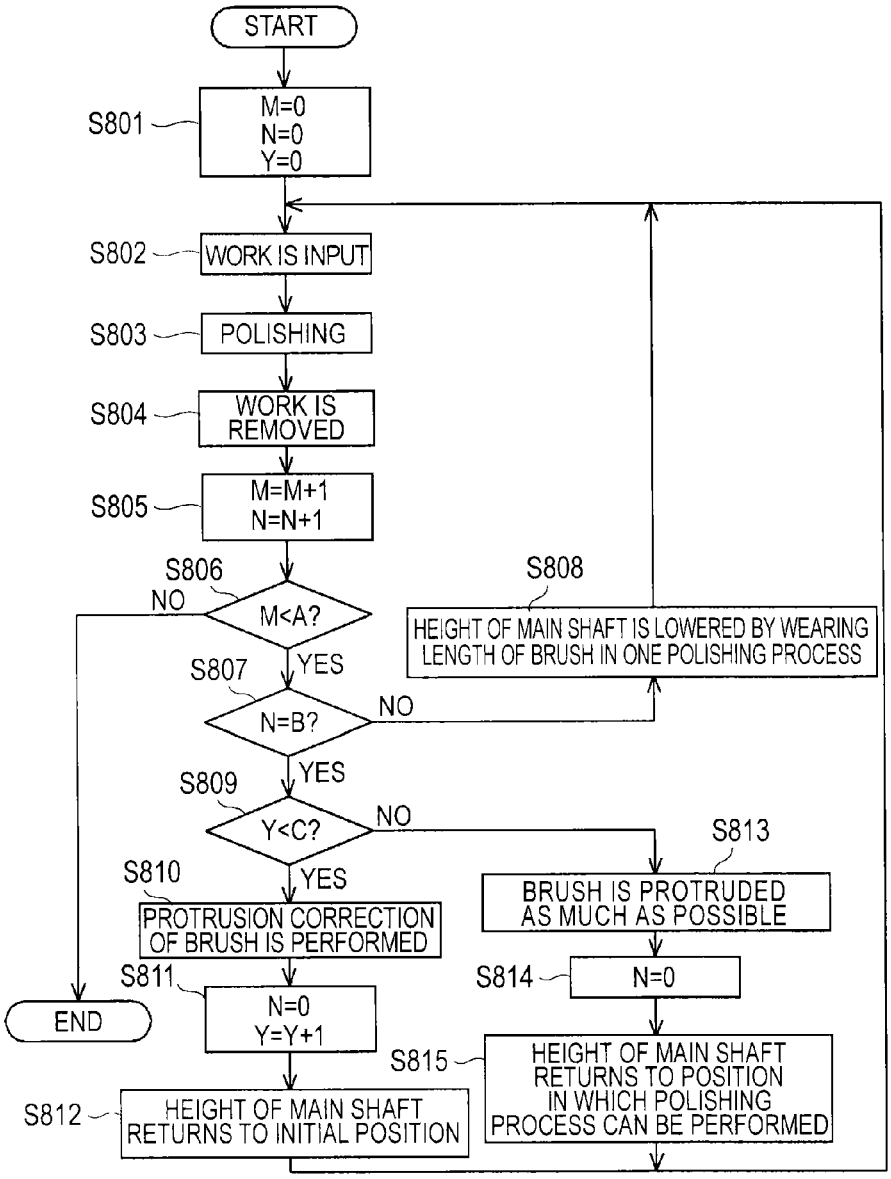

M: TOTAL NUMBER OF POLISHING FROM START OF USE OF BRUSH
N: NUMBER OF POLISHING SINCE PROTRUDING LENGTH OF BRUSH IS INITIAL LENGTH
Y NUMBER OF PROTRUSION CORRECTION FROM START OF USE OF BRUSH
A: NUMBER OF POLISHING IN WHICH BRUSH CANNOT BE USED BY LIFE OF BRUSH
B: NUMBER OF POLISHING SINCE PROTRUDING LENGTH OF BRUSH IS INITIAL LENGTH UNTIL PROTRUSION CORRECTION IS PERFORMED
C: NUMBER OF POLISHING IN WHICH PROTRUSION CORRECTION CANNOT BE PERFORMED DUE TO LIFE OF BRUSH

POLISHING BRUSH AND MACHINING TOOL USING THE SAME

CROSS REFERENCE TO RELATED APPLICATIONS

This application is based on and claims priority under 35 U.S.C. §119 to Japanese Patent Application 2013-258258, filed on Dec. 13, 2013, the entire contents of which are incorporated herein by reference.

TECHNICAL FIELD

This disclosure relates to a polishing brush for removing burrs on a surface of a workpiece metal by polishing and a machining tool using the same.

BACKGROUND DISCUSSION

In metal components used in automobiles, high accuracy is required. For improving the accuracy of the metal components, it is necessary for burrs generated by processing to be reliably removed by polishing. In the related art, for removing the burrs of a workpiece metal component, a brush that is formed by bundling a plurality of linear abrasive materials in which resin binder is impregnated and cured in fibrous alumina is generally used. In order to remove the burrs, the brush is rotated while tips of the abrasive materials of the brush come into contact with a surface of the workpiece metal component.

A polishing machine capable of stably exerting performance of a brush-shaped grindstone by setting a cutting amount of work of the brush-shaped grindstone using alumina to be constant is disclosed in JP 2005-111640A (Reference 1). In the polishing machine, a tool holding body holding the brush-shaped grindstone using alumina is movably supported in a direction toward the work (workpiece metal component) to a holder body and a direction away from the work, and is biased by a predetermined biasing force toward the work by a compression coil spring. Thus, even if the brush-shaped grindstone is worn, since the tool holding body is moved toward the work by the compression coil spring and a position of the tip of the brush-shaped grindstone is constantly maintained, a cutting load of the brush-shaped grindstone to the work, that is, a reaction force received from the work, is constant and the cutting amount toward the work can be constantly maintained.

In the polishing machine described in Reference 1, the brush-shaped grindstone is biased by the compression coil spring. The brush-shaped grindstone is configured of a brush case and a brush-shaped grindstone body inserted therein. The brush-shaped grindstone body is configured of a plurality of linear abrasive materials in which binder resin is impregnated and cured in set yarns of alumina and a cylindrical holder that collectively holds a base end side of the linear abrasive materials. The polishing is performed by protruding tips of the linear abrasive materials from a lower end of the brush case and moving the tips of the linear abrasive materials while the tips come into contact with the surface of the work, and the burrs are removed. The burrs are removed and thereby the tips of the linear abrasive materials are worn.

Since the brush case and the brush-shaped grindstone body are integrally moved, as a number of polishing times increases, a protruding length of the linear abrasive materials protruding from the lower end of the brush case is shortened due to wear. Thus, after a predetermined number of removal times have elapsed, it is necessary to stop the polishing machine and to manually protrude the linear abrasive materials from the lower end of the brush case, and therefore complete automation of a polishing process is not achieved. Furthermore, in order to stably perform the polishing, the cutting load toward the work has to be constant, but a practical cutting load is changed by a compression length of the compression coil spring. In order to make the cutting load constant, before the polishing process is started, it is necessary to abut the brush-shaped grindstone to a master work and adjust a height of the brush-shaped grindstone. Thus, time for adjusting the cutting load is necessary in addition to the practical polishing time for the time of the polishing process and it takes much extra time. As described above, in a structure of the brush-shaped grindstone, there is room for further improvement.

SUMMARY

Thus, a need exists for a polishing brush which is not suspectable to the drawback mentioned above.

A feature of a polishing brush according to an aspect of this disclosure resides in a configuration that the polishing brush includes a brush body that includes a cylindrical base section and linear abrasive materials extending from a bottom surface of one side of the base section along a direction of a center of an axis of the base section, and removes burrs and performs polishing on a surface of a workpiece metal by relatively moving the abrasive materials and the workpiece metal while tips of the abrasive materials come into contact with a surface of the workpiece metal; a brush guide that is coaxial with the center of the axis and is disposed on the outside of the brush body in a radial direction so that the tips of the abrasive materials protrude from an end portion; and a displacement mechanism that changes protruding lengths of the abrasive materials from the end portion.

A machining tool according to another aspect of this disclosure resides in a configuration that the machining tool includes: a main shaft; a drive device that drives a key; and a polishing brush that is mounted on the main shaft, wherein the polishing brush has a brush body that includes a cylindrical base section and linear abrasive materials extending from a bottom surface of one side of the base section along a direction of a center of an axis of the base section, and removes burrs and performs polishing on a surface of a workpiece metal by relatively moving the abrasive materials and the workpiece metal while tips of the abrasive materials come into contact with a surface of the workpiece metal, a brush guide that is coaxial with the center of the axis and is disposed on the outside of the brush body in a radial direction so that the tips of the abrasive materials protrude from an end portion, and a displacement mechanism that changes protruding lengths of the abrasive materials from the end portion, wherein the displacement mechanism has a displacement shaft that is coaxially mounted on the center of the axis of the brush body and is integrated with the brush body, and a displacement nut which is screwed to the displacement shaft and in which a gear is formed on a part of an outer periphery, wherein the displacement nut is rotatably accommodated in an accommodation portion that is a part of the brush guide, and wherein an opening is formed in the accommodation portion and the gear is exposed from the opening to the outside, ball plungers by which balls are advanced and retracted along the radial direction are mounted on one of an inner peripheral surface of the accommodation portion and an outer peripheral surface of the displacement nut, and a plurality of recessed holes into which the balls are fitted are formed on the other of the inner peripheral surface of the accommodation portion and the outer peripheral surface of the displacement nut along a circumferential direction at equal intervals, and wherein the number of the recessed holes is equal to the number of teeth of the gear, if the key and the tooth of the gear are collided by relatively moving the key and the polishing brush, fitting between the recessed hole and the ball is released, the displacement nut is rotated, the ball is fitted into another recessed hole adjacent to the recessed hole, rotation of the displacement nut is stopped, and thereby the displacement shaft is moved by a predetermined length along an axial direction and the protruding lengths of the abrasive materials are changed.

BRIEF DESCRIPTION OF THE DRAWINGS

The foregoing and additional features and characteristics of this disclosure will become more apparent from the following detailed description considered with the reference to the accompanying drawings, wherein:

FIG. 8 is a flowchart of a control procedure of automatic operation of a polishing process by a control device;

DETAILED DESCRIPTION

1. First Embodiment

Structure of Machining Tool

Figure 1:
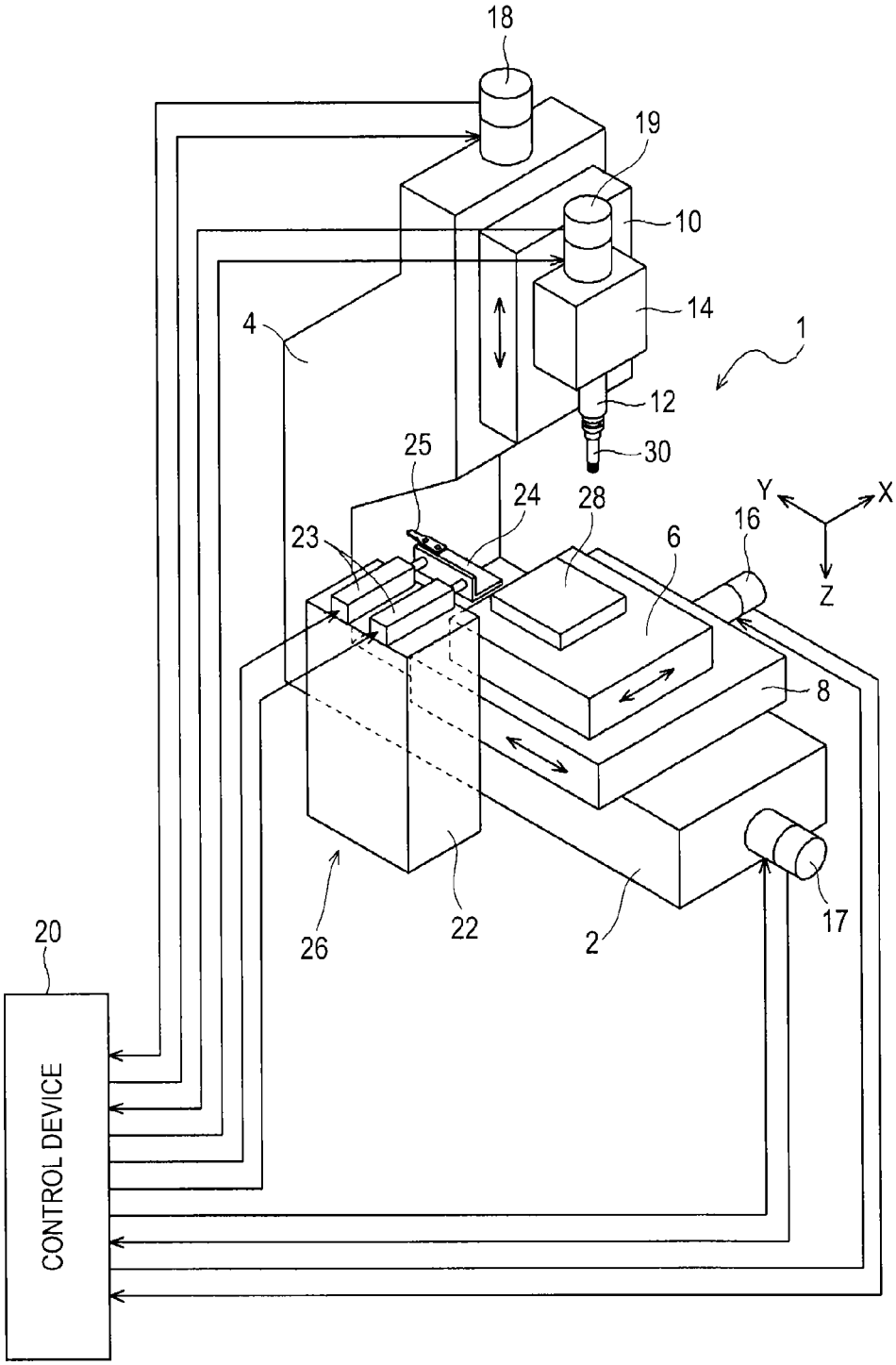
FIG. 1 is a perspective view illustrating a schematic configuration of a machining center including a polishing brush according to an embodiment.

Hereinafter, a first embodiment of a polishing brush 30 disclosed here will be described with reference to the drawings. As illustrated in FIG. 1, the polishing brush 30 is used by being mounting on a main shaft 12 of a machining center 1 controlled by a computer. The machining center 1 is an example of a machining tool.

The machining center 1 includes an X table 6 and a Y table 8 which are mounted on a base stand 2, a column 4 that is integrated with the base stand 2, a Z slider 10 that is mounted on the column 4, a main shaft head 14 that is mounted on the Z slider 10, and the main shaft 12 that is mounted on the main shaft head 14. The X table 6, the Y table 8, and the Z slider 10 are driven by motors 16, 17, and 18 with encoders and are respectively independently movable in an X axis direction, a Y axis direction, and a Z axis direction. The main shaft 12 is driven to be rotated by a motor 19 with an encoder. Control of an entirety of the machining center 1 including drive of the motors 16, 17, 18, and 19 with the encoders is performed by a control device 20. Since a configuration of the machining center 1 is similar to the existing one, detailed description of each configuration element will be omitted.

A key driving device 26 is provided in a side of the machining center 1. The key driving device 26 has a base stand 22, two air cylinders 23 that are mounted on an upper surface of the base stand 22 so as to reciprocate in the X axis direction, a metal holder 24 that is mounted on tips of the air cylinders 23 and reciprocates together with the cylinders, and a key 25 formed of metal such as iron that is mounted on the holder 24 so as to protrude from the holder 24 along the Y axis direction. In the key driving device 26, the key 25 reciprocates along the X axis direction by driving the air cylinders 23. If the key 25 can be rapidly moved, the driving source is not limited to the air cylinders 23 and may be an oil cylinder or another driving source. A specific operation of the key driving device 26 is described later.

When removing burrs from a work 28 by performing a polishing process using the machining center 1, first, the X table 6, the Y table 8, and the Z slider 10 are moved in a state where the work 28 is fixed to the X table 6, and a tip of the polishing brush 30 mounted on the main shaft 12 comes into contact with a surface of the work 28. At this time, hereinafter, an overlap length between the work 28 and the polishing brush 30 from the surface of the work 28 in the Z axis direction is referred to as "cutting length". The cutting length is related to a pressing force of the polishing brush 30 toward the work 28 and is related to an amount of polishing of the work 28. Then, the burrs are removed by rotating the polishing brush 30 while moving the X table 6 and the Y table 8 in a state where the Z slider 10 is fixed. Thus, the work 28 having necessary dimension accuracy and a surface roughness is obtained. Moreover, the work 28 is an example of a workpiece metal.

When polishing is completed, the polishing brush 30 is separated from the work 28. Then, although not illustrated in FIG. 1, the work 28 in which the polishing is completed is automatically replaced by the work 28 of the next polishing object and new polishing process is started.

Structure of Polishing Brush

Figure 2:
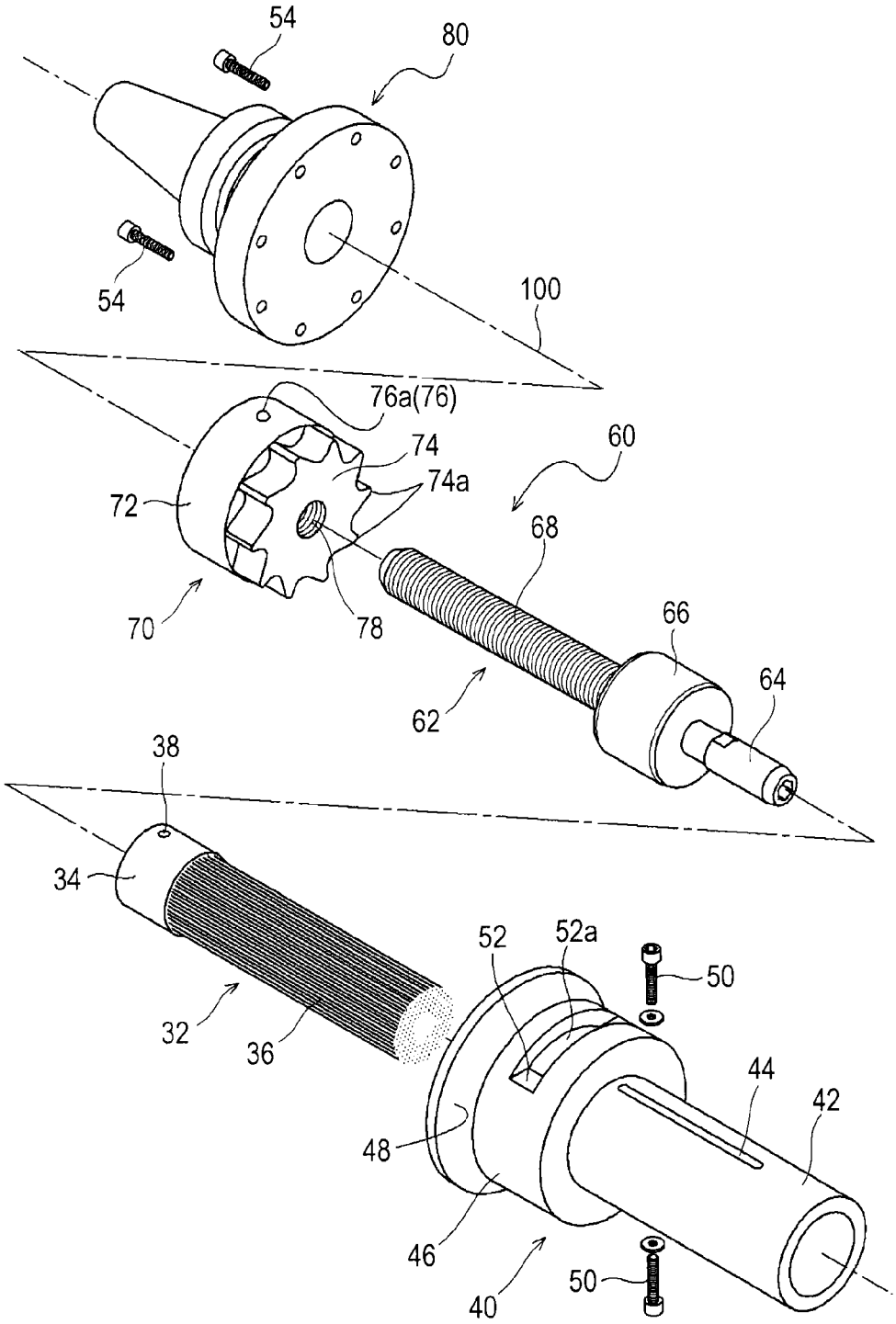
FIG. 2 is an exploded perspective view illustrating a configuration of the polishing brush.
Figure 3:
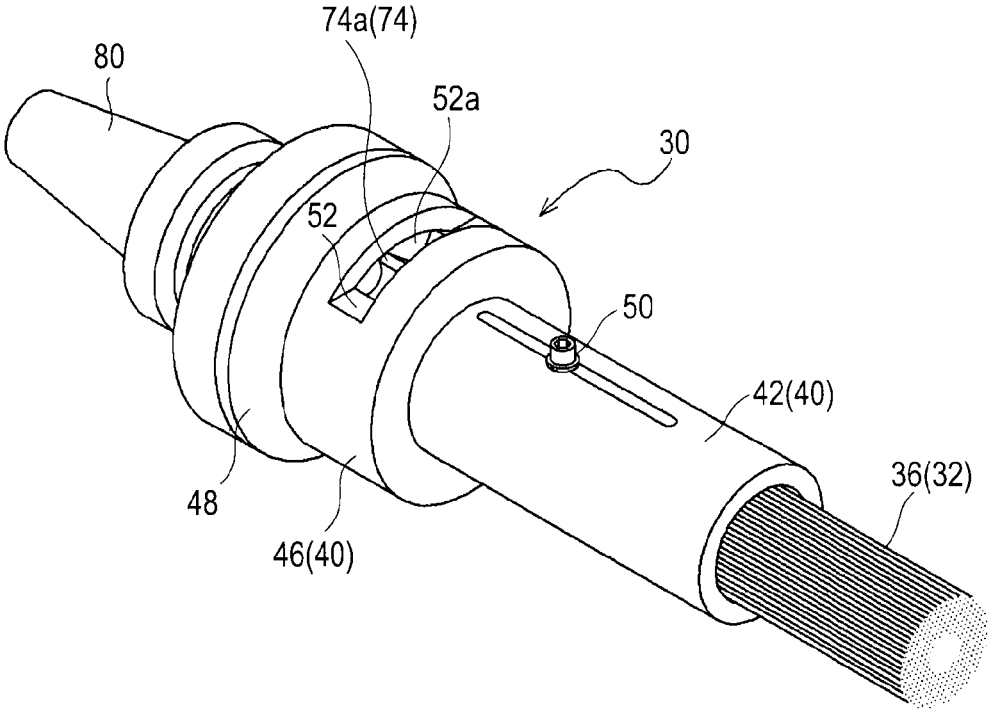
FIG. 3 is a perspective view of the polishing brush.
Figure 4:
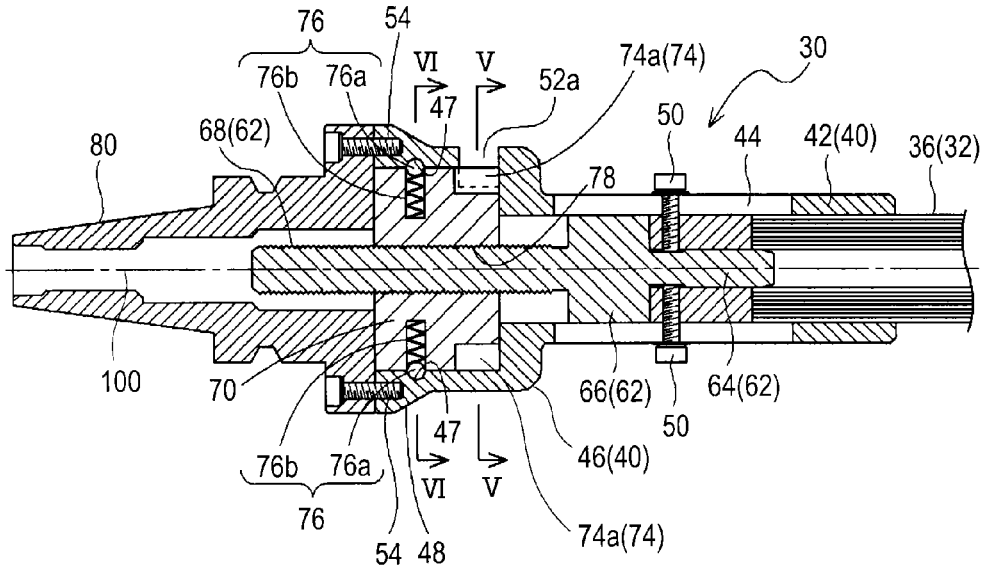
FIG. 4 is a vertical cross-sectional view of the polishing brush.

As illustrated in FIGS. 2 to 4, the polishing brush 30 includes a brush body 32, a brush guide 40, a displacement mechanism 60, and a shank 80.

The brush body 32 includes a cylindrical base section 34 made of metal and a brush 36 that is mounted on a bottom surface of one side of the base section 34 and extends along a direction of an axis 100 of the base section 34. The brush 36 is an example of abrasive materials. The brush 36 is formed by impregnating resin such as nylon into fibrous alumina and processing the alumina in a linear shape, and bundling a plurality of the linear alumina. In the polishing process, a tip of the brush 36 comes into contact with the surface of the work 28 and the brush 36 and the work 28 are relatively moved, and thereby the brush 36 cuts and removes the burrs of the surface of the work 28 with the alumina fibers while wearing the tip of the brush 36. Two screw holes 38 penetrating to an inner space are provided on a side surface of the base section 34.

The brush 36 of the embodiment uses alumina, but is not limited to the embodiment. For example, it is possible to use the brush 36 utilizing an optimal material such as silicon carbide or diamond depending on a material or a purpose of processing of the work 28.

The brush guide 40 is made of metal and has a shape such that a cylindrical first accommodation portion 42 and second accommodation portion 46 having different outer diameters are coaxially disposed and a flange 48 is provided in an end portion of the second accommodation portion 46 having a large diameter. The second accommodation portion 46 is an example of the accommodation portion. As illustrated in FIG. 4, an inner space of the first accommodation portion 42 and an inner space of the second accommodation portion 46 are connected. The brush body 32 and a part of the displacement mechanism 60 described below are accommodated in the inner space of the first accommodation portion 42 and most of the rest of the displacement mechanism 60 is accommodated in the inner space of the second accommodation portion 46. The brush guide 40 is configured such that the axis of the brush guide 40 is coaxial with the axis 100 in a state where the brush body 32 is accommodated in the first accommodation portion 42, and the tip of the brush 36 protrudes from an end portion of the brush guide 40. Two long holes 44 that are through holes on the side surface of the first accommodation portion 42 are formed in an extending direction of the axis 100.

The brush body 32 is accommodated in the first accommodation portion 42. In a state where a fitting convex section 64 of a displacement shaft 62 described below is fitted into an inner space of the base section 34, bolts 50 pass through the long holes 44 from the outside of the first accommodation portion 42 and are screwed into the screw holes 38, and tighten the fitting convex section 64. Thus, the brush body 32 and the displacement shaft 62 are fixed. Therefore, the brush body 32 is movable only in a direction along the axis 100 with respect to the brush guide 40 and is not rotated in the circumferential direction.

Figure 5:
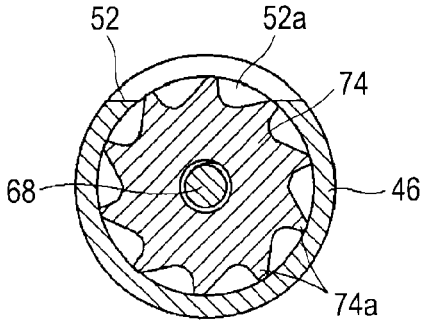
FIG. 5 is a cross-sectional view that is taken along line V-V of FIG. 4.

As illustrated in FIGS. 4 and 5, an arched notch 52 is formed on the side surface of the second accommodation portion 46 and thereby an opening 52*a* connecting the inner space and the outer space of the second accommodation portion 46 is formed. Furthermore, as illustrated in FIG. 6, ten hemispherical recessed holes 47 are formed on an inner peripheral surface of the second accommodation portion 46 in which the notch 52 is not formed at equal intervals on a plane vertical to the axis 100.

As illustrated in FIG. 2, the displacement mechanism 60 includes the displacement shaft 62 and a displacement nut 70. The displacement mechanism 60 has a function for changing a length (hereinafter, simply referred to as a protruding length) protruding from the end portion of the brush guide 40 of the brush 36. The displacement shaft 62 includes the fitting convex section 64, a sliding section 66, and a screw shaft 68, and those members are disposed so as to be coaxial. The fitting convex section 64 has a cylindrical shape. As illustrated in FIG. 4, the fitting convex section 64 passes through the inner space of the base section 34 until the base section 34 comes into contact with the sliding section 66 and is fastened by the bolts 50. Thus, the displacement shaft 62 and the brush body 32 are coaxially integrated. The sliding section 66 is disposed adjacent to the fitting convex section 64 and has a cylindrical shape of which an outer diameter is the same as that of the base section 34. The sliding section 66 is utilized in a state of being inserted into the first accommodation portion 42 together with the base section 34. The screw shaft 68 is disposed opposite to the fitting convex section 64 with respect to the sliding section 66 and an outer diameter thereof is smaller than an outer diameter of the sliding section 66.

The displacement nut 70 has a shape such that a cylindrical columnar section 72 and a gear section 74 in which a gear having ten teeth 74*a* is formed are coaxially laminated and integrated. A screw hole 78 engaging with the screw shaft 68 coaxial with the outer periphery is formed in a center portion of the displacement nut 70 and the screw shaft 68 further extends passing through the screw hole 78. As illustrated in FIG. 4, the displacement nut 70 has a size such that an entirety of the displacement nut 70 is accommodated in the second accommodation portion 46 of the brush guide 40 having a gap of a degree capable of rotating. As illustrated in FIG. 5, the teeth 74*a* of the gear section 74 have an asymmetrical shape such as a saw blade. As illustrated in FIGS. 3 to 5, in a state where the displacement nut 70 is accommodated in the second accommodation portion 46, the teeth 74*a* are exposed from the opening 52*a*.

Figure 6:
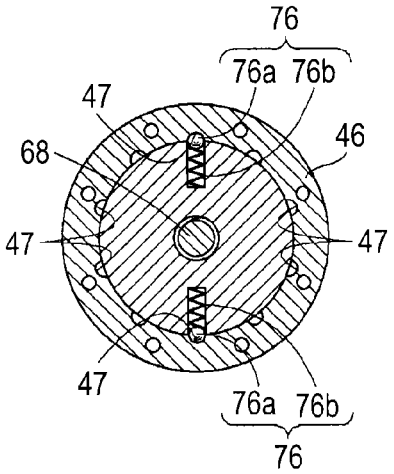
FIG. 6 is a cross-sectional view that is taken along line VI-VI of FIG. 4.

As illustrated in FIG. 6, two ball plungers 76 that advance and retract balls 76*a* biased to the outside in a radial direction by springs 76*b* are provided in the columnar section 72. As illustrated in FIG. 4, in a state where the displacement nut 70 is accommodated in the second accommodation portion 46, if each plunger 76 faces the recessed hole 47, the ball 76*a* engages with the recessed hole 47 by a biasing force of the spring 76*b* and movement of the displacement nut 70 in the circumferential direction is fixed. As illustrated in FIG. 5, when the ball 76*a* engages with the recessed hole 47, a positional relationship between the teeth 74*a*, the ball plungers 76, and the recessed holes 47 is determined so that the tooth 74*a* always comes in the center of the opening 52*a*.

In the embodiment, two ball plungers 76 are used, but the number of the ball plungers 76 is not limited to this. The number of the ball plungers 76 may be one or three or more.

As illustrated in FIG. 4, the shank 80 is integrated with the flange 48 of the brush guide 40 by fastening with bolts 54. A surface of the shank 80 abutting the brush guide 40 is overlapped with the displacement nut 70 when viewed along the axis 100. Thus, the displacement nut 70 is rotatable in the circumferential direction in the inner space of the second accommodation portion 46 but is not moved in the direction along the axis 100. The screw shaft 68 protruding from the displacement nut 70 extends until the inner space of the shank 80. As illustrated in FIG. 1, the shank 80 is inserted and fixed to a chuck (not illustrated) that is in the main shaft 12 of the machining center 1 and thereby the polishing brush 30 rotates integrally with the main shaft 12.

In the embodiment, the base section 34 is a cylindrical shape and the brush 36 does not exist in the vicinity of the center of the bottom surface of the base section 34, but the configuration is not limited to the embodiment. The base section 34 may be a cylindrical shape having a bottom and the brush 36 may exist in an entirety of the bottom surface of the base section 34.

In the embodiment, the ball plungers 76 are mounted on the displacement nut 70 and the recessed holes 47 are formed in the second accommodation portion 46, but this configuration is not limited to the embodiment. The recessed holes 47 may be formed in the displacement nut 70 and the ball plungers 76 may be mounted on the second accommodation portion 46.

Protruding Operation of Brush

When the polishing brush 30 performs the polishing process of the work 28, the polishing process is performed in a state where the brush 36 is protruded by a predetermined length from the tip of the brush guide 40. Hereinafter, the protruding length of the brush 36 before the polishing process is performed is referred to as an initial length. When the burrs of the work 28 are removed by the polishing process, the tip of the brush 36 is worn and shortened from the initial length in exchange for the removal of burrs. In order to realize a desired polishing process, it is necessary for the protruding length of the brush 36 to be maintained in a moderate range without being too long and without being too short. This is because if the protruding length of the brush 36 is too long, the tip of the brush 36 spreads by pressing of the brush 36 to the work 28 during polishing and a necessary amount of the polishing cannot be ensured, and if the protruding length thereof is too short, stiffness of the brush 36 is strong and the work 28 is excessively cut. A range of the protruding length of the brush 36 in which a desired polishing process can be performed and a wear amount of the brush 36 when one polishing process is performed have already been found by the inventors.

When repeatedly performing the polishing of the work 28 by the brush 36 protruded only by the initial length by replacing the work 28, the protruding length of the brush 36 is gradually shortened due to wear. Thus, after performing a predetermined number of the polishing process, since the protruding length of the brush 36 is shortened too much and a desired polishing process cannot be performed, the brush 36 is protruded from the brush guide 40 and it is necessary to return the protruding length to the initial length again. In the embodiment, in order to return the protruding length of the brush 36 to the initial length, the operation is performed by rotating the displacement nut 70.

Figure 7:
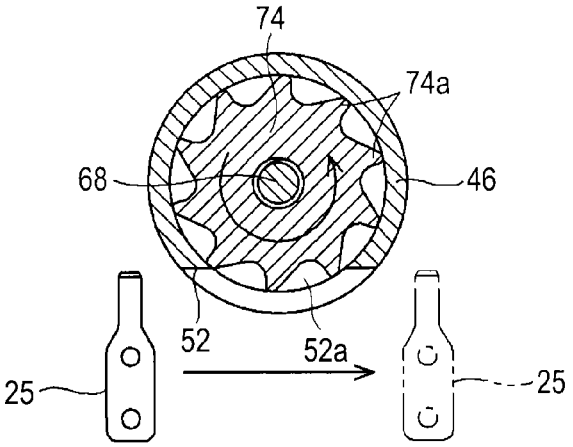
FIG. 7 is a schematic view illustrating a principle of rotating of a displacement nut.

Specifically, in the machining center 1, the key 25 and the notch 52 approach each other at the same height by moving the X table 6, the Y table 8, and the Z slider 10. In this state, the air cylinders 23 are operated and as illustrated in FIG. 7, the key 25 is operated in the X axis direction. Since the tooth 74*a* is exposed in the center of the opening 52*a*, the key 25 moving at a high speed by the air cylinders 23 collides with the tooth 74*a* by entering the notch 52. The force is greater than a force to maintain the engagement of the ball 76*a* and the recessed hole 47, and the engagement of the ball 76*a* and the recessed hole 47 is released, and then the gear section 74, that is, the displacement nut 70, rotates. Then, in a portion in which the displacement nut 70 rotates by 36 degrees, the ball 76*a* is fitted into an adjacent recessed hole 47 and therefore, the rotation of the displacement nut 70 stops. At this time, the adjacent tooth 74*a* stops in the center of the opening 52*a*. Thus, when rotating the next displacement nut 70, it is possible to apply the same force to the tooth 74*a* and to make the rotation angle of the displacement nut 70 constant.

If the displacement nut 70 rotates by 36 degrees, the screw hole 78 also rotates by 36 degrees and the screw shaft 68 (displacement shaft 62) moves along the axis 100 by a corresponding length thereof, that is, by a length of a tenth of a screw pitch. Since the displacement shaft 62 and the brush body 32 are integrated, the brush 36 protrudes from the brush guide 40 by a moving amount of the displacement shaft 62. The protruding length of the brush 36 returns to the initial length due to the protrusion. That is, the protruding length of the brush 36 by the rotation of the displacement nut 70 by 36 degrees is equal to the wear amount of the brush 36 that is worn by performing a predetermined number of polishing process. Hereinafter, an operation that the worn brush 36 is protruded to be the initial length by rotating the displacement nut 70 by 36 degrees is defined as protrusion correction of the brush 36 is performed.

As described above, if a predetermined number of polishing process is repeated since the protruding length of the brush 36 is the initial length and the brush 36 is worn, the brush 36 is protruded by the wear length that is worn by the protrusion correction and the protruding length is returned to the initial length again, and then the polishing process is continued. It is possible to perform the polishing process continuously and automatically by performing automatically and repeatedly a series of the operation until the brush 36 cannot be used by being worn from the start of the use of the brush 36.

Automatic Performance of Polishing Process

Next, a flow for automatically performing the polishing process for the life of the brush 36 by mounting the polishing brush 30 on the main shaft 12 of the machining center 1 and by controlling the control device 20 will be described with reference to FIG. 8.

Before starting the polishing process of the work 28, the protruding length of a new brush 36 is manually fitted to the initial length and then the polishing brush 30 is mounted on the main shaft 12.

When starting continuous automatic performance of the polishing process, the control device 20 respectively sets a total number (M) of polishing from the start of use of the brush 36, the number (N) of polishing that is performed since the protruding length of the brush 36 is the initial length, and the number (Y) of protrusion correction of the brush 36 from start of the use of the brush 36 to be 0 in an internal executing program (S801).

Next, the control device 20 inputs the work 28 of the polishing object (S802), moves the X table 6, the Y table 8, and the Z slider 10, and controls the tip of the brush 36 of the polishing brush 30 so as to come into contact with the work 28. Then, the control device 20 performs the polishing of the work 28 by controlling the polishing brush 30 to be rotated while moving the X table 6 and the Y table 8 without moving the Z slider 10 (without changing the height) (S803). The work 28 of which the polishing process is completed is automatically removed (S804). Then, in the executing program, 1 is respectively added to M and N (S805).

Next, the control device 20 compares the number of M to the number (A) of polishing in which the brush 36 cannot be used due to the life of the brush 36 (S806). If the number of M is smaller than the number of A (Yes of S806), the control device 20 determines that the life of the brush 36 has not come and the brush 36 can be continuously used, and performs S807.

Next, the control device 20 compares the number of N to the number (B) of polishing until the protrusion correction is performed since the protruding length of the brush 36 is the initial length (S807). If the number of N is smaller than the number of B (No of S807), the control device 20 determines that it is not yet necessary for the protrusion correction of the brush 36 to be performed and controls the height of the main shaft 12 to be lowered by the wear length of the brush 36 in one polishing process by moving the Z slider 10 (S808). Then, the work 28 of the next polishing object is input (S802). If the number of N is equal to the number of B (Yes of S807), the control device 20 determines that the time to perform the protrusion correction of the brush 36 has come, and performs S809.

Next, the control device 20 compares the number of Y to the number of C in which the protrusion correction cannot be performed due to the life of the brush 36 (S809). If the number of Y is smaller than the number of C (Yes of S809), the protrusion correction of the brush 36 can be performed and the control device 20 performs the protrusion correction of the brush 36 and controls the protruding length of the brush 36 to be the initial length (S810). Then, the number of N is returned to 0 and 1 is added to Y (S811). Thereafter, the Z slider 10 is moved and the height of the main shaft 12 is returned to a position (initial position) when starting automatic performance of the polishing process (S812). Then, the work 28 of the next polishing object is input (S802).

If the number of Y and the number of C are equal (No of S809), the control device 20 determines that the protruding length of the brush 36 cannot be returned to the initial length by the protrusion correction because a remaining length of the brush 36 is too short. Then, the control device 20 controls the brush 36 to be protruded as much as possible (S813) although not returned to the initial length. Then, the number of N is returned to 0 (S814) and the height of the main shaft 12 is returned to a position in which the polishing process can be performed with the protruding length by moving the Z slider 10 (S815). Thereafter, the work 28 of the next polishing object is input (S802).

The brush 36 that is determined as No in the step of S809 is approaching the time when the brush 36 cannot be used due to the life thereof and then if a predetermined number of polishing of the work 28 is performed by repeating the steps from S802 to S808, the number of M is equal to the number of A and No is determined in the step of S806. Thus, the control device 20 determines that the replacement timing comes due to the life of the brush 36 and completes the automatic operation to replace the brush 36.

As described above, the control device 20 performs the control in the flow illustrated in FIG. 8 and thereby the polishing process can be performed continuously and automatically until the brush 36 cannot be used due to the life thereof from the start of the use of the brush 36 and it is possible to increase productivity of the polishing process.

Figure 9:
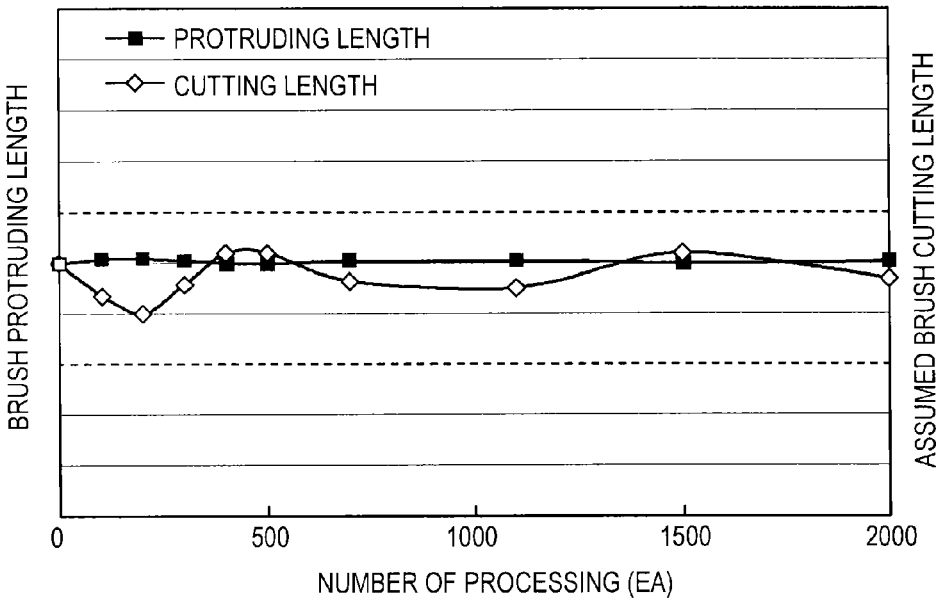
FIG. 9 is a graph illustrating a change in a protruding length of the brush from a brush guide and a cutting length of the brush toward a work when the automatic operation is performed in a control process.

Results illustrated in FIG. 9 are obtained by performing continuously and automatically the polishing process with respect to 2000 works 28. For all works 28, since both "protruding length" of the brush 36 and "cutting length" of the brush 36 were within a scope of a specification indicated by a thick broken line, it was confirmed that a desired polishing process could be performed with respect to all 2000 works.

2. Second Embodiment

Hereinafter, a second embodiment of a polishing brush 30 disclosed here will be described with reference to the drawings. In the embodiment, structures of a brush guide 40 and a displacement mechanism 60 are different from those of the first embodiment and the other structures are the same as each other. Thus, in the description of the embodiment, the same reference numerals are given to the same configurations as in the first embodiment and description of the same configurations will be omitted.

Figure 10:
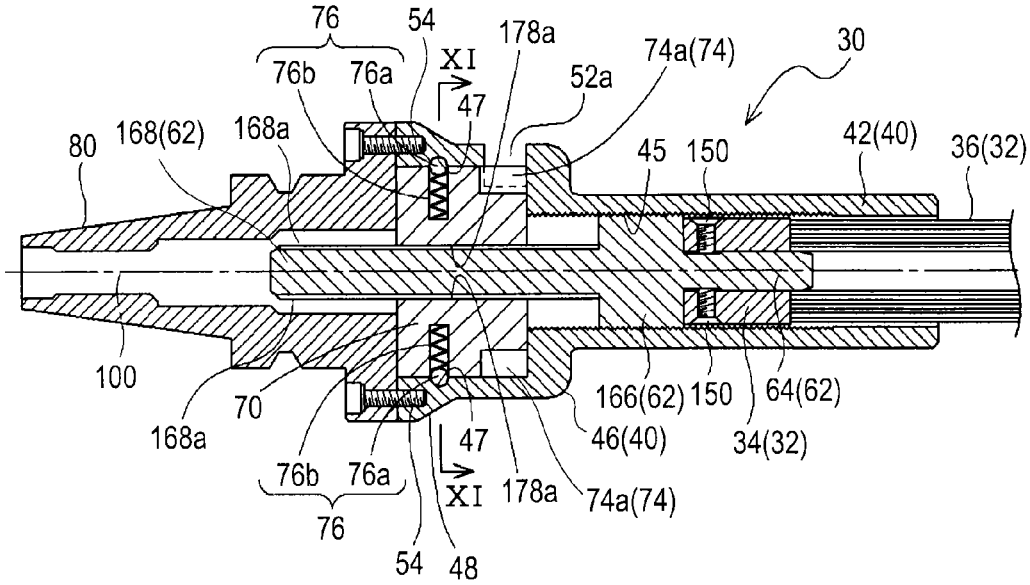
FIG. 10 is a vertical cross-sectional view of a polishing brush according to a second embodiment.
Figure 11:
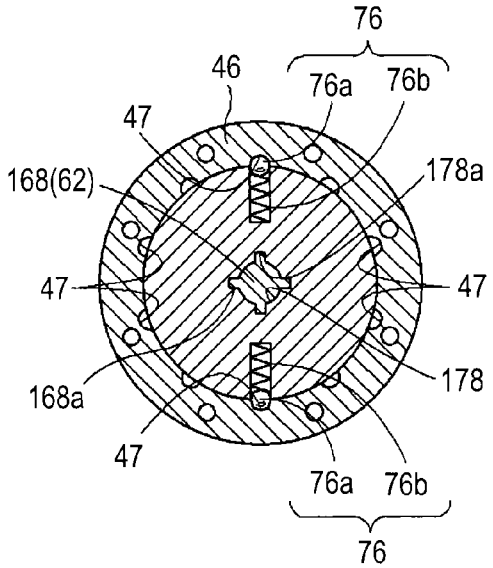
FIG. 11 is a cross-sectional view that is taken along line XI-XI of FIG. 10.

As illustrated in FIGS. 10 and 11, the brush guide 40 of the polishing brush 30 according to the embodiment does not have a long hole 44 and a female screw 45 is formed on an inner peripheral surface of a first accommodation portion 42. A brush body 32 and a displacement shaft 62 are integrated by being fastened with flat head bolts 150 in a state where a fitting convex section 64 is fitted into an inner space of a base section 34. At this time, a head of the flat head bolt 150 does not protrude from an outer peripheral surface of the base section 34.

A screw section 166 in which a male screw engaging with the female screw 45 is formed on an outer peripheral surface is provided instead of a sliding section 66 of the displacement shaft 62. Furthermore, a key shaft 168 in which four keys 168*a* directed to the outside in the radial direction are formed on an outer peripheral surface of a cylindrical shaft is provided instead of a screw shaft 68.

In a displacement nut 70, key holes 178 in which key grooves 178*a* fitting to the keys 168*a* are formed in cylindrical holes are provided instead of a screw hole 78. Since a slight gap exists between the key 168*a* and the key groove 178*a* in a state where the key shaft 168 is inserted into the key hole 178, the displacement shaft 62 rotates according to the rotation of the displacement nut 70 and can move along an axis 100.

A protrusion correction in the embodiment is performed similar to that of the first embodiment. When the displacement nut 70 is rotated by 36 degrees by receiving a force from a key 25, accordingly, the key shaft 168 is also rotated by 36 degrees. Thus, since the screw section 166 integrated with the key shaft 168 is also rotated by 36 degrees, the displacement shaft 62 moves by one tenth of a screw pitch of the screw section 166 along the axis 100. Thus, the brush body 32 integrated with the displacement shaft 62 protrudes from the brush guide 40 by a moving amount of the displacement shaft 62 while rotating by 36 degrees.

In each embodiment described above, for one protrusion correction, the displacement nut 70 is rotated by 36 degrees, but is not limited to the embodiment. The displacement nut 70 may be rotated by another angle by changing the number of teeth of the teeth 74*a* of the gear section 74.

In each embodiment described above, in order to rotate the displacement nut 70, the force is applied to the tooth 74*a* by moving the key 25 by the air cylinders 23 mounted on the base stand 22 other than the machining center 1, but the configuration is not limited to the embodiment. The key 25 is mounted on the X table 6 or the Y table 8 of the machining center 1 and the X table 6 or the Y table 8 is moved, and thereby a force may be applied to the tooth 74*a*.

The embodiments disclosed here can be used in the polishing brush that removes the burrs on the surface of the workpiece metal by polishing and the machining tool using the same.

A feature of a polishing brush according to an aspect disclosed here resides in a configuration that the polishing brush includes a brush body that includes a cylindrical base section and linear abrasive materials extending from a bottom surface of one side of the base section along a direction of a center of an axis of the base section, and removes burrs and performs polishing on a surface of a workpiece metal by relatively moving the abrasive materials and the workpiece metal while tips of the abrasive materials come into contact with a surface of the workpiece metal; a brush guide that is coaxial with the center of the axis and is disposed on the outside of the brush body in a radial direction so that the tips of the abrasive materials protrude from an end portion; and a displacement mechanism that changes protruding lengths of the abrasive materials from the end portion.

If polishing of the workpiece metal is performed by the abrasive materials, the abrasive materials are shortened due to wear in exchange for the removal of burrs. In order to realize a polishing process in which the removal of predetermined burrs can be repeatedly and stably performed, it is necessary for the protruding lengths of the abrasive materials to be maintained in a moderate range without being too long and without being too short. This is because if the protruding lengths of the abrasive materials are too long, the tips of the abrasive materials spread by pressing of the abrasive materials to the workpiece metal during polishing and a necessary amount of the polishing cannot be ensured, and if the protruding lengths are too short, stiffness of the abrasive materials is strong and the workpiece metal is excessively cut. In the aspect disclosed here, since the abrasive materials are protruded by the displacement mechanism, the displacement mechanism is automatically operated when performing control of the polishing process and the displacement mechanism is controlled so as to protrude the abrasive materials by the same length as a wear length of the abrasive materials worn due to the polishing. Thus, it is possible to return the protruding lengths of the abrasive materials to original lengths and to perform the polishing process continuously and automatically for the life of the abrasive materials.

In the polishing brush according to the aspect disclosed here, it is preferable that the displacement mechanism has a displacement shaft that is coaxially mounted on the center of the axis of the brush body and is integrated with the brush body, and a displacement nut which is screwed to the displacement shaft and in which a gear is formed on a part of an outer periphery, the displacement nut is rotatably accommodated in an accommodation portion that is a part of the brush guide, an opening is formed in the accommodation portion, and the gear is exposed from the opening to the outside.

With such a configuration, it is possible to rotate the displacement nut by applying a force from the outside to the gear exposed from the opening. If the displacement nut is rotated, the displacement shaft screwed to the displacement nut moves in the axial direction by a predetermined amount. Thus, the brush body integrated with the displacement shaft also moves in the axial direction and it is possible to protrude the abrasive materials from the brush guide. Therefore, applying of the force from the outside to the gear to rotate the displacement nut is automatically performed during control of the polishing process. Thus, it is possible to perform the polishing process continuously and automatically for the life of the abrasive materials.

In the polishing brush according to the aspect disclosed here, it is preferable that ball plungers by which balls are advanced and retracted along the radial direction are mounted on one of an inner peripheral surface of the accommodation portion and an outer peripheral surface of the displacement nut, a plurality of recessed holes into which the balls are fitted are formed on the other of the inner peripheral surface of the accommodation portion and the outer peripheral surface of the displacement nut along a circumferential direction at equal intervals, and the number of the recessed holes is equal to the number of teeth of the gear.

If the ball of the ball plungers and the recessed holes are configured to fit into each other when the teeth of the gear is at the center of the opening, the displacement nut is fixed in that state and does not rotate. Then, since the teeth of the gear and the plurality of recessed holes are formed along the circumferential direction at equal intervals, fitting between the ball and the recessed hole is released by applying the force from the outside to the gear and when the rotation of the displacement nut is stopped by fitting between a recessed hole adjacent to the recessed hole and the ball, the adjacent tooth is also at the center of the opening. Therefore, it is possible to always stop the tooth at the center of the opening, to apply the equal force to the tooth when rotating the displacement nut in the next time, and to make a rotation angle of the displacement nut constant. Since the abrasive materials protrude from the brush guide by the rotation of the displacement nut, it is possible to make the protruding amount of the abrasive materials protruding from the brush guide constant and to protrude the abrasive materials by the same length as a wear length of the abrasive materials worn.

A machining tool according to another aspect disclosed here resides in a configuration that the machining tool includes: a main shaft; a drive device that drives a key; and a polishing brush that is mounted on the main shaft, wherein the polishing brush has a brush body that includes a cylindrical base section and linear abrasive materials extending from a bottom surface of one side of the base section along a direction of a center of an axis of the base section, and removes burrs and performs polishing on a surface of a workpiece metal by relatively moving the abrasive materials and the workpiece metal while tips of the abrasive materials come into contact with a surface of the workpiece metal, a brush guide that is coaxial with the center of the axis and is disposed on the outside of the brush body in a radial direction so that the tips of the abrasive materials protrude from an end portion, and a displacement mechanism that changes protruding lengths of the abrasive materials from the end portion, wherein the displacement mechanism has a displacement shaft that is coaxially mounted on the center of the axis of the brush body and is integrated with the brush body, and a displacement nut which is screwed to the displacement shaft and in which a gear is formed on a part of an outer periphery, wherein the displacement nut is rotatably accommodated in an accommodation portion that is a part of the brush guide, and wherein an opening is formed in the accommodation portion and the gear is exposed from the opening to the outside, ball plungers by which balls are advanced and retracted along the radial direction are mounted on one of an inner peripheral surface of the accommodation portion and an outer peripheral surface of the displacement nut, and a plurality of recessed holes into which the balls are fitted are formed on the other of the inner peripheral surface of the accommodation portion and the outer peripheral surface of the displacement nut along a circumferential direction at equal intervals, and wherein the number of the recessed holes is equal to the number of teeth of the gear, if the key and the tooth of the gear are collided by relatively moving the key and the polishing brush, fitting between the recessed hole and the ball is released, the displacement nut is rotated, the ball is fitted into another recessed hole adjacent to the recessed hole, rotation of the displacement nut is stopped, and thereby the displacement shaft is moved by a predetermined length along an axial direction and the protruding lengths of the abrasive materials are changed.

In such a configuration, the displacement nut is rotated at a constant angle using the key whenever a predetermined number of times of the polishing process are performed in a series of control of the machining tool. Thus, it is possible to control the abrasive materials so as to be protruded by the same length as the wear length of the abrasive materials worn due to the polishing. Thus, it is possible to return the protruding lengths of the abrasive materials to original lengths and to perform the polishing process continuously and automatically for the life of the abrasive materials.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A polishing brush comprising:

a brush body that includes a cylindrical base section and linear abrasive materials extending from a bottom surface of one side of the base section along a direction of a center of an axis of the base section, and removes burrs and performs polishing on a surface of a workpiece metal by relatively moving the abrasive materials and the workpiece metal while tips of the abrasive materials come into contact with a surface of the workpiece metal;

a brush guide that is coaxial with the center of the axis and is disposed on an outside of the brush body in a radial direction so that the tips of the abrasive materials protrude from an end portion;

a displacement mechanism that changes protruding lengths of the abrasive materials from the end portion;

an accommodation portion that accommodates the displacement mechanism; and a gear mechanism that gives a rotational power to the displacement mechanism, the gear mechanism being exposed to an outside from an opening formed in the accommodation portion, wherein the rotational power changes protruding lengths of the abrasive materials.

2. The polishing brush according to claim 1, wherein the displacement mechanism has a displacement shaft that is coaxially mounted on the center of the axis of the brush body and is integrated with the brush body, wherein the gear mechanism includes a displacement nut which is screwed to the displacement shaft and in which a gear is formed on a part of an outer periphery, and wherein the displacement nut is rotatably accommodated in the accommodation portion.

3. The polishing brush according to claim 2, wherein ball plungers by which balls are advanced and retracted along the radial direction are mounted on one of an inner peripheral surface of the accommodation portion and an outer peripheral surface of the displacement nut, wherein a plurality of recessed holes into which the balls are fitted are formed on the other of the inner peripheral surface of the accommodation portion and the outer peripheral surface of the displacement nut along a circumferential direction at equal intervals, and wherein the number of the recessed holes is equal to the number of teeth of the gear.

4. A machining tool comprising:

a main shaft;

a drive device that drives a key; and a polishing brush that is mounted on the main shaft, wherein the polishing brush has a brush body that includes a cylindrical base section and linear abrasive materials extending from a bottom surface of one side of the base section along a direction of a center of an axis of the base section, and removes burrs and performs polishing on a surface of a workpiece metal by relatively moving the abrasive materials and the workpiece metal while tips of the abrasive materials come into contact with a surface of the workpiece metal, a brush guide that is coaxial with the center of the axis and is disposed on the outside of the brush body in a radial direction so that the tips of the abrasive materials protrude from an end portion, and a displacement mechanism that changes protruding lengths of the abrasive materials from the end portion, wherein the displacement mechanism has a displacement shaft that is coaxially mounted on the center of the axis of the brush body and is integrated with the brush body, and a displacement nut which is screwed to the displacement shaft and in which a gear is formed on a part of an outer periphery, wherein the displacement nut is rotatably accommodated in an accommodation portion that is a part of the brush guide, and wherein an opening is formed in the accommodation portion and the gear is exposed from the opening to the outside, ball plungers by which balls are advanced and retracted along the radial direction are mounted on one of an inner peripheral surface of the accommodation portion and an outer peripheral surface of the displacement nut, and a plurality of recessed holes into which the balls are fitted are formed on the other of the inner peripheral surface of the accommodation portion and the outer peripheral surface of the displacement nut along a circumferential direction at equal intervals, and wherein the number of the recessed holes is equal to the number of teeth of the gear, if the key and the tooth of the gear are collided by relatively moving the key and the polishing brush, fitting between the recessed hole and the ball is released, the displacement nut is rotated, the ball is fitted into another recessed hole adjacent to the recessed hole, rotation of the displacement nut is stopped, and thereby the displacement shaft is moved by a predetermined length along an axial direction and the protruding lengths of the abrasive materials are changed.

5. A polishing brush comprising:

a brush body that includes a cylindrical base section and linear abrasive materials extending from a bottom surface of one side of the base section along a direction of a center of an axis of the base section, and removes burrs and performs polishing on a surface of a workpiece metal by relatively moving the abrasive materials and the workpiece metal while tips of the abrasive materials come into contact with a surface of the workpiece metal;

a brush guide that is coaxial with the center of the axis and is disposed on an outside of the brush body in a radial direction so that the tips of the abrasive materials protrude from an end portion; and a displacement mechanism that changes protruding lengths of the abrasive materials from the end portion, the displacement mechanism including a displacement shaft that is coaxially mounted on a center of an axis of the brush body, and a nut which is screwed to the displacement shaft, wherein a relative movement between the displacement shaft and the nut in an axial direction changes protruding lengths of the abrasive materials.

6. The polishing brush according to claim 1, wherein the accommodation portion includes long holes, and wherein bolts pass through the long holes from the outside and are fixed to the brush body.

7. The polishing brush according to claim 1, further comprising:

ball plungers mounted on the accommodation portion that regulate rotation of the gear mechanism.

* * * * *